US007034717B2

(12) United States Patent
Brown

(10) Patent No.: US 7,034,717 B2
(45) **Date of Patent: *Apr. 25, 2006**

(54) PILOT HOUSE CRITICAL EVENT DETECTION AND ALARM SYSTEM

(76) Inventor: Richard Albert Brown, 7170 Bayou Paul Rd., St. Gabriel, LA (US) 70776

( * ) Notice: Subject to any disclaimer, the term of this patent is extended or adjusted under 35 U.S.C. 154(b) by 0 days.

This patent is subject to a terminal disclaimer.

(21) Appl. No.: 10/631,265

(22) Filed: Jul. 31, 2003

(65) Prior Publication Data

US 2005/0024205 A1 Feb. 3, 2005

(51) Int. Cl.
*G08B 23/00* (2006.01)

(52) U.S. Cl. ..... 340/984; 340/985; 340/540; 340/565; 340/309.16; 340/573.2

(58) Field of Classification Search ..... 340/984, 340/985, 540, 565, 309.16, 573.1
See application file for complete search history.

(56) References Cited

U.S. PATENT DOCUMENTS 5,045,839 A * 9/1991 Ellis et al. ..... 340/539.11
5,805,064 A * 9/1998 Yorkey ..... 340/550
6,211,783 B1 * 4/2001 Wang ..... 340/506

* cited by examiner

*Primary Examiner*—Julie Bichngoc Lieu
(74) *Attorney, Agent, or Firm*—Patrick Stellitano

(57) ABSTRACT

The present invention provides apparatus and methods for indicating the existence of a critical event within a pilot house, including the existence of a condition of no motion.

17 Claims, 2 Drawing Sheets

PILOT HOUSE CRITICAL EVENT DETECTION AND ALARM SYSTEM

TECHNICAL FIELD OF THE INVENTION

The present invention relates to the field of providing detection of a critical event in a pilothouse of a vessel traveling in rivers and waterways.

BACKGROUND OF THE INVENTION

Pilots of vessels traveling in rivers and other waterways are entrusted with a great responsibility to safely navigate their vessels and avoid collisions. This is especially important when approaching bridges carrying passenger vehicles over the waterway. In a recent incident, a pilot of a barge suffered an incapacitating medical condition preventing him from avoiding a collision between the barge and support pillars for a highway bridge. The collision caused the bridge to collapse and passenger vehicles plunged into the water killing and injuring many people. Thus, there is a need for an invention that can prevent collisions from occurring.

SUMMARY OF THE INVENTION

Accordingly, the present invention presents methods and apparatus for indicating when there is no motion in the pilothouse for a duration of time, indicating that the pilot is absent or incapacitated.

According to one aspect of the invention, a plurality of sensors is provided to detect the existence of motion in the pilothouse. When no motion is detected for a period of time, a critical event is deemed to have occurred. The invention provides, in such event, one or more alarms. A silent alarm is provided that can be observed on a display. An audible alarm provided within the pilothouse if the condition of no-motion persist after a duration of time. An audible alarm can be transmitted outside the pilot house, if the condition of motion continues to persist. Further, a panic button is provided to enable activation of the alarm should activation be deemed warranted.

According to another aspect of the invention, critical events, such as a condition of no motion, or panic, or system tampering, are recorded in memory, and the record of events may be transmitted to another location for observation and evaluation.

The foregoing has outlined rather broadly aspects, features and technical advantages of the present invention in order that the detailed description of the invention that follows may be better understood. Additional aspects, features and advantages of the invention will be described hereinafter. It should be appreciated by those skilled in the art that the disclosure provided herein may be readily utilized as a basis for modifying or designing other structures for carrying out the same purposes of the present invention. Persons of skill in the art will realize that such equivalent constructions do not depart from the spirit and scope of the invention as set forth in the appended claims, and that not all objects attainable by the present invention need be attained in each and every embodiment that falls within the scope of the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
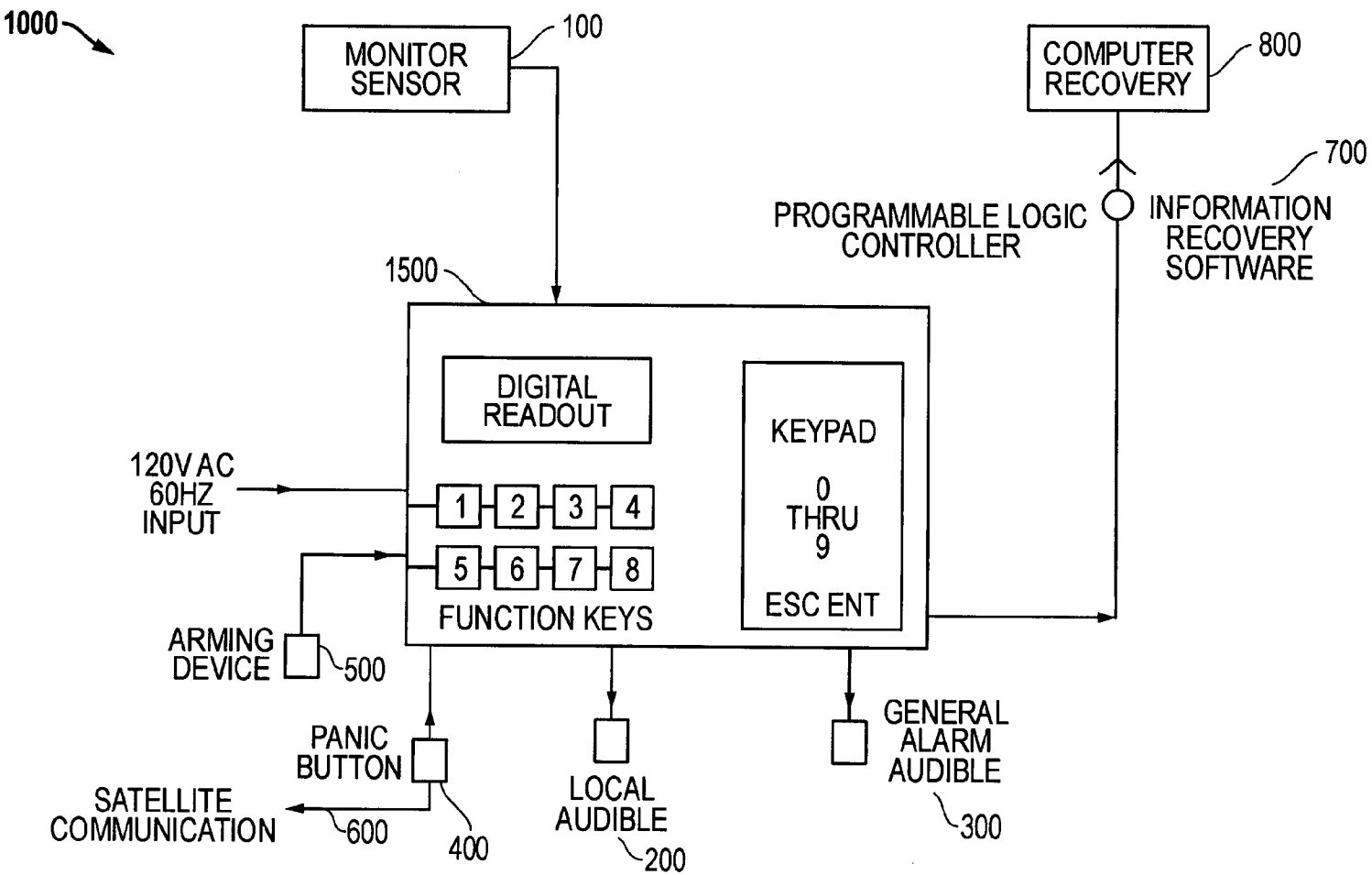
FIG. 1 is a block diagram of a preferred embodiment of the present invention.

A preferred embodiment of the present invention is shown as system 1000 in FIG. 1. System 1000 comprises a set of sensors 100, and a control panel 1500. Additionally, electrical signals are generated within control panel 1500 that activate a local audible alarm 200, and a general alarm 300. Further, system 1000 preferably comprises a panic button 400, arming device 500 and links 600 to radio communication and software 700 for downloading information to a computer 800.

Implementation of the invention provides for installation of sensors 100 of the present invention within the pilothouse to ensure that any substantial motion within the pilot house will be detected, indicating a no-alarm condition. Sensors 100 are infrared sensors. When there is motion within the pilothouse, the infrared energy being detected by one or more of the sensors 100 will be changing. That is, the detection of motion occurs because of the change in the infrared energy distribution caused by human motion within the pilothouse. Preferably the sensors are positioned and calibrated to enable detection of any motion occurring more than 36 inches from the floor of the pilothouse.

System 1000 is activated within a duration of time, T0, after the throttle is placed in forward or reverse by an arming device 500 responsive to the vessel's throttle. Duration T0 is preferably 15 seconds. Thus, when the throttle is not in forward or reverse, the system 1000 is in a quiescent state, and will not produce an alarm indicating no motion.

However, when system 1000 is activated, then detection of loss of motion will result in the following actions. If the loss of motion persists for a duration of time T1, preferably 50 seconds, then one or more Light Emitting Diodes (LEDs) will illuminate on the control panel 1500. The illuminated lights indicate which sensor has not detected motion for at least the time interval T1. If the condition persists that there is no motion detected by any sensor for a duration of time T2>T1, where T2 is preferably 60 seconds, then an audible local alarm signal will sound in the pilot house for a period of time δTa, preferably 10 seconds. This audible alarm 200 alerts the person in the pilothouse in charge of navigation of the persistent lack of motion. Audible local alarm 200 will be silenced by the resumption of motion within this δTa interval, and then, timing is reset.

If the condition of no motion persists for the entire duration δTa, then the general alarm 300 will begin to sound. General alarm 300 will sound throughout various locations of the vessel, preferably through a general crew address system. The general alarm signal is preferably a sequence of two-second pulses, each pulse separated by 2 seconds. Also, a panic button 400 located in close proximity to the vessel's pilot station is provided in the event that the pilot senses the onset of an incapacitating condition or other incident warranting the general alarm. Since the control panel 1500 will also be located in close proximity to the pilot's station within the pilothouse, the panic button is conveniently located on the control panel. When the panic button is depressed the general alarm will sound. Depressing a silence button on control panel 1500 will silence the general alarm and then, timing is reset Whenever the general alarm sounds, system 1000 may be configured to send a radio signal on a link 600 indicating the existence of an alarm condition. Thus, if the vessel is equipped with a satellite uplink, the existence of an alarm condition may be transmitted by satellite to an off-vessel site where such alarm conditions can be monitored.

A tamper alarm is also provided so that if a motion sensor is tampered with, by, for example, removing its cover, a continuous local alarm will sound. A tamper alarm also activates if a sensor is unplugged or loses electrical connection to its power source or to control panel 1500. The tamper alarm is silenced by correcting the situation that caused the alarm to sound.

As previously noted, when a motion sensor detects no motion for a period of time, an LED corresponding to the non-detecting sensor will flash. If not all the sensors detect no-motion while at least one sensor is non-detecting for a time period T3, preferably two hours, a message is displayed on control panel 15, indicating the sensor needs repair or replacement.

In each case when an alarm is activated the status and type of alarm is displayed on control panel 1500. The display of control panel 1500 preferably comprises light emitting diodes, as well as a liquid crystal display. If control panel 1500 loses power or otherwise loses electrical connectivity to an external unit, the date and time of this event is recorded in non-volatile memory for later review.

Control panel 1500 is provided with a set of function keys which are programmed to enable the system user to test and use the system. For example, the following functions, each corresponding to a different function key, are preferably provided:

1. RESET—when depressed will silence the alarm, but not the tamper alarm;
2. SYSTEM DELAY—when held depressed for two seconds, then 1 minute will be added to the alarm delay so that the alarm will only be activated by a condition of no detection of motion when that condition persist for at least 1 minute;
3. TEST (SILENT)—when held depressed for two seconds, a test of the system will be conducted with alarms held inaudible, followed by a return to normal operation;
4. TEST (FULL)—when held depressed for two seconds, a test of the system will be conducted with audible alarms, with the local alarm sounding for 10 seconds, followed by the general alarm sounding for 2 cycles, followed by a return to normal operation;
5. EVENT HISTORY—by depressing this key a specified number of times, the history of the selected event will be displayed:
   1. General alarm
   2. Panic alarm
   3. Power failure
   4. Tamper alarm Twenty seconds after this function key is last depressed the monitor will return to normal display;
6. SCROLL UP/DOWN—keys are provided to enable the user to scroll through a list of events in the event history, observing the time and day of the events.
7. PASSWORD—a key is provided to enable entry of a password required to operate the control panel and to access the functions and displays provided.

Clearly, persons of skill in the art will recognize alternative or additional functions that may be executed by the user upon selection of a function key.

Figure 2:
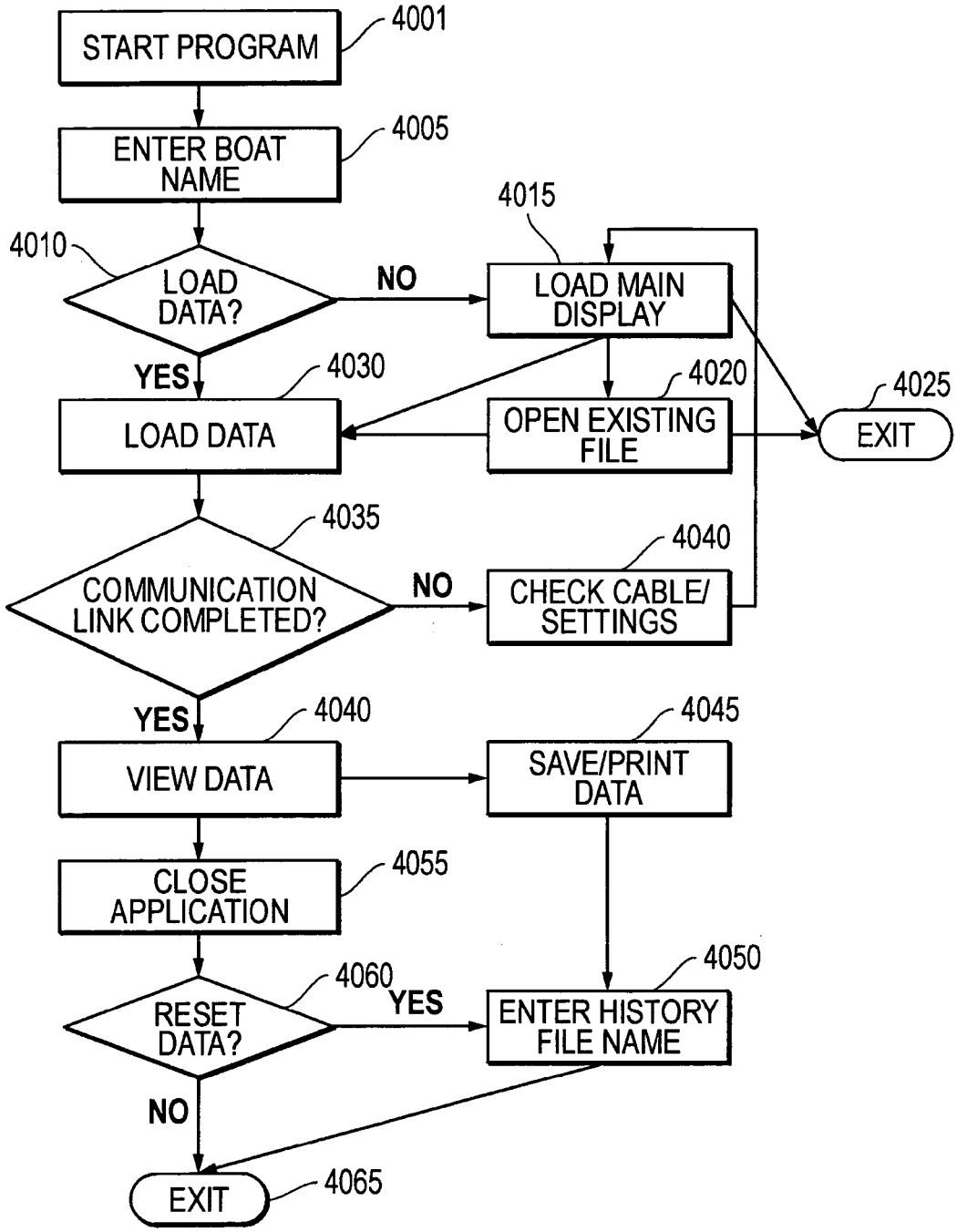
FIG. 2 is a flow chart of an embodiment of software of the present invention.

Software is 700 is provided to enable downloading of data accumulated by the system. The data may be downloaded to a computer with a display device to enable the user to view the event history, and other data recorded by the system. FIG. 2 shows a flow chart of the operation of an embodiment of the software of the present invention. When the software program 4000 is started 4001, a pop-up screen appears enabling the user to enter the name or other identification of the vessel. 4005. An option 4010 is then provided to download data that has been accumulated by the system 1000 over a period of time. If this option is selected the data will be selected for download. 4030. Alternatively, previously downloaded data may be retrieved. 4015. This previously downloaded data may be displayed or printed. 4020. Then the program may be exited, 4025, or the previously downloaded data may be selected for loading. 4030.

Still referring to FIG. 2, a decision is made 4035 whether communication link is completed. 4035. If not, a message is sent to check the cable and settings. The result of this check is displayed. 4015. If the link is completed the data can be viewed in the Explorer Window. 4040. The data may then be saved and/or printed 4045, and the program is exited. 4065. Then, a pop-up enables the user to name the file. 4050. Alternatively, the application can be closed. 4055. If the option 4060 is selected to reset data, again, the user is enabled to name the file. 4050, and the program is exited. 4065. If not, the program is exited. 4065.

Thus, the present invention provides for the download and analysis of data collected by system 1000 over a period of time. This enables a record of events in the pilothouse to be observed, and evaluated to determine, for example, what events led to occurrence of a collision.

Thus, although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for detecting a critical event in the pilothouse of a vessel, comprising the steps of:

providing a plurality of motion sensors at fixed locations within the pilot house to detect a condition of no motion relative to at least one of the fixed sensors within the pilot house;

determining if a throttle of the vessel is in a forward or reverse condition;

providing an alarm responsive to a no-motion condition if the throttle is in a forward or reverse condition; and determining if a sensor detects no motion for an excessive length of time during which other sensors detect motion to determine if a sensor is faulty.

2. The method of claim 1, wherein said condition exists only if no motion is detected by a plurality of sensors during the same time interval.

3. The method of claim 1, wherein an alarm is inaudible if said condition persists for a first specified time interval and is audible if said condition persists for a second specified time interval greater than the first time interval.

4. The method of claim 1, further comprising a mechanism for recording a history of conditions for which an alarm is provided.

5. The method of claim 1, wherein said sensors are responsive to a change in spatial distribution of infrared energy within the pilothouse.

6. A system for detecting a critical event in the pilothouse of a vessel, comprising:

a plurality of sensors at fixed locations within the pilot house to detect a condition of no motion relative to at least one of the fixed sensors within the pilot house;

machine-accessible memory located on the vessel to store historical data corresponding to detection of conditions of no motion;

an alarm responsive to said no-motion condition; and a timing mechanism to determine if a sensor is faulty.

7. The system of claim 6, wherein an alarm is audible only if said condition persists for a specified time interval.

8. The system of claim 6, wherein an alarm is provided only if said condition is detected when a throttle of the vessel is in forward or reverse state.

9. The system of claim 6, wherein an alarm is inaudible if said condition persists for a first specified time interval and is audible if said condition persists for a second specified time interval greater than the first time interval.

10. The system of claim 6, further comprising a tamper alarm to occur if tampering with a sensor is detected.

11. A system for detecting a critical event in the pilothouse of a vessel, comprising:

a plurality of sensors at fixed locations within the pilot house responsive to motion within the pilothouse;

a mechanism to determine an event of no motion detected by a sensor for a specified time interval;

a mechanism in the pilot house to store and display a history of events including events of no detected motion;

an alarm indicating the existence of a condition of no motion for a predeterminable duration of time; and a timing mechanism to determine if a sensor is faulty.

12. The system of claim 11, further comprising a mechanism to communicate a history of events to a place exterior to the pilot house.

13. The system of claim 11, further comprising a tamper alarm to occur if tampering with a sensor is detected.

14. The system of claim 11, further comprising a detector to enable the alarm only if a throttle of the vessel is in a forward or reverse state.

15. The system of claim 11, wherein said alarm comprises a first alarm activated if said condition persists for a first specified time interval and a second alarm activated if said condition persists for a second specified time interval greater than the first time interval.

16. The system of claim 6, wherein the historical data comprises a time of loss of electrical power in the system.

17. The system of claim 11, wherein the events comprise a loss of electrical power in the system.

* * * * *